US011400574B2

(12) United States Patent
Namouz

(10) Patent No.: US 11,400,574 B2
(45) Date of Patent: Aug. 2, 2022

(54) GAS SPRING FASTENER DRIVER

(71) Applicant: TTI (MACAO COMMERCIAL OFFSHORE) LIMITED, Macau (MO)

(72) Inventor: Essam Namouz, Greenville, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 517 days.

(21) Appl. No.: 15/627,737

(22) Filed: Jun. 20, 2017

(65) Prior Publication Data

US 2017/0361441 A1 Dec. 21, 2017

Related U.S. Application Data

(60) Provisional application No. 62/352,630, filed on Jun. 21, 2016.

(51) Int. Cl.
*B25C 1/04* (2006.01)
*B25C 1/06* (2006.01)
(Continued)

(52) U.S. Cl.
CPC ..... *B25C 1/04* (2013.01); *B25C 1/008* (2013.01); *B25C 1/06* (2013.01); *B25C 1/047* (2013.01); *B25C 5/1665* (2013.01); *B27F 7/09* (2013.01)

(58) Field of Classification Search
CPC .. B25C 1/04; B25C 1/008; B25C 1/06; B25C 1/047; B25C 5/1665; B27F 7/09
(Continued)

(56) References Cited

U.S. PATENT DOCUMENTS 2,944,522 A 7/1960 Doyle
2,946,313 A * 7/1960 Powers ..... B25C 1/041 92/24
(Continued)

FOREIGN PATENT DOCUMENTS

CN 202129781 U 2/2012
CN 105339137 A 2/2016
(Continued)

OTHER PUBLICATIONS

Examination Report No. 1 for Australian Application No. 2017204205, dated Apr. 19, 2018, 7 pages.
(Continued)

*Primary Examiner* — Chelsea E Stinson
(74) *Attorney, Agent, or Firm* — Michael Best & Friedrich LLP

(57) ABSTRACT

A fastener driver including a main housing, a drive blade movable from a retracted position to a driven position for driving a fastener into a workpiece, and a gas spring mechanism for driving the drive blade from the retracted position to the driven position. The gas spring mechanism includes a cylinder housing containing a pressurized gas, and a piston movable relative to the cylinder housing and biased by the pressurized gas from a retracted position toward a driven position. The cylinder housing is displaceable along a longitudinal axis of the piston relative to the main housing and away from the drive blade, while the piston remains stationary relative to the main housing, to reduce the pressure of the pressurized gas within the cylinder housing.

16 Claims, 4 Drawing Sheets

(51) Int. Cl.
*B25C 1/00* (2006.01)
*B25C 5/16* (2006.01)
*B27F 7/09* (2006.01)

(58) Field of Classification Search
USPC ..... 227/130
See application file for complete search history.

(56) References Cited

U.S. PATENT DOCUMENTS 3,190,189 A 6/1965 Mosetich
3,278,103 A 10/1966 Juilfs
3,809,307 A 5/1974 Wandel
3,858,780 A 1/1975 Perkins
3,871,566 A 3/1975 Elliesen
3,940,044 A 2/1976 LaPointe
3,948,426 A 4/1976 La Pointe
4,122,904 A 10/1978 Haytayan
4,215,808 A 8/1980 Sollberger
4,227,637 A 10/1980 Haytayan
4,260,092 A 4/1981 Austin
4,339,065 A 7/1982 Haytayan
4,346,831 A 8/1982 Haytayan
4,351,464 A * 9/1982 Fehrs ..... B25C 1/008 227/132
4,384,668 A 5/1983 Tutomu
4,452,387 A 6/1984 Haytayan
RE32,452 E 7/1987 Nikolich
4,821,938 A 4/1989 Haytayan
4,909,419 A 3/1990 Yamada
4,936,192 A 6/1990 Johnsson et al.
5,020,712 A 6/1991 Monacelli
5,511,715 A 4/1996 Crutcher
5,645,208 A 7/1997 Haytayan
5,683,024 A 11/1997 Eminger
5,720,423 A 2/1998 Kondo
5,921,156 A 7/1999 Takezaki
6,145,724 A 11/2000 Shkolnikov
6,318,615 B1 11/2001 Walter
RE38,834 E 10/2005 Perra
7,073,468 B2 7/2006 Akiba
7,137,540 B2 11/2006 Terrell
7,290,691 B1 11/2007 Wen
7,490,747 B2 2/2009 Kitagawa
7,686,197 B2 3/2010 Kosuge
8,011,441 B2 9/2011 Leimbach
8,011,547 B2 9/2011 Leimbach
8,230,941 B2 7/2012 Leimbach
8,267,296 B2 9/2012 Leimbach
8,267,297 B2 9/2012 Leimbach
8,286,722 B2 10/2012 Leimbach
8,387,718 B2 3/2013 Leimbach
8,602,282 B2 12/2013 Leimbach
8,763,874 B2 7/2014 McCardle
8,875,969 B2 11/2014 Pedicini
9,539,714 B1 1/2017 Pedicini
2005/0156008 A1 7/2005 Komazaki
2005/0218176 A1 10/2005 Schell
2006/0261127 A1 11/2006 Wolf
2011/0198381 A1 8/2011 McCardle et al.
2014/0069671 A1 3/2014 Leimbach
2016/0288305 A1 10/2016 McCardle
2017/0274513 A1* 9/2017 Pedicini ..... B25C 1/06

FOREIGN PATENT DOCUMENTS

DE 102012219288 4/2014
GB 1555901 A 11/1979
WO WO-2005095063 A1 10/2005
WO WO 2014/063967 * 5/2014 ..... B25C 1/06

OTHER PUBLICATIONS

Extended European Search Report for European Application No. 17177241.1, dated Jun. 14, 2018, 9 pages.

* cited by examiner

GAS SPRING FASTENER DRIVER

CROSS-REFERENCE TO RELATED APPLICATIONS

This application claims priority to U.S. Provisional Patent Application No. 62/352,630 filed on Jun. 21, 2016, the entire content of which is incorporated herein by reference.

FIELD OF THE INVENTION

The present invention relates to power tools, and more particularly to gas spring fastener drivers.

BACKGROUND OF THE INVENTION

There are various fastener drivers used to drive fasteners (e.g., nails, tacks, staples, etc.) into a workpiece known in the art. These fastener drivers operate utilizing various means (e.g., compressed air generated by an air compressor, electrical energy, flywheel mechanisms) known in the art, but often these designs are met with power, size, and cost constraints.

SUMMARY OF THE INVENTION

The present invention provides, in one aspect, a fastener driver including a main housing, a drive blade movable from a retracted position to a driven position for driving a fastener into a workpiece, and a gas spring mechanism for driving the drive blade from the retracted position to the driven position. The gas spring mechanism includes a cylinder housing containing a pressurized gas, and a piston movable relative to the cylinder housing and biased by the pressurized gas from a retracted position toward a driven position. The cylinder housing is displaceable along a longitudinal axis of the piston relative to the main housing and away from the drive blade, while the piston remains stationary relative to the main housing, to reduce the pressure of the pressurized gas within the cylinder housing.

The present invention provides, in another aspect, a method of clearing a jammed fastener in a fastener driver including a drive blade and a gas spring mechanism for driving the drive blade from a retracted position to a driven position. The method includes moving a portion of the gas spring mechanism from a first position to a second position, thereby reducing the pressure within the gas spring mechanism. The method further includes clearing the jammed fastener, and returning the portion of the gas spring mechanism from the second position back to the first position, thereby increasing the pressure within the gas spring mechanism.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
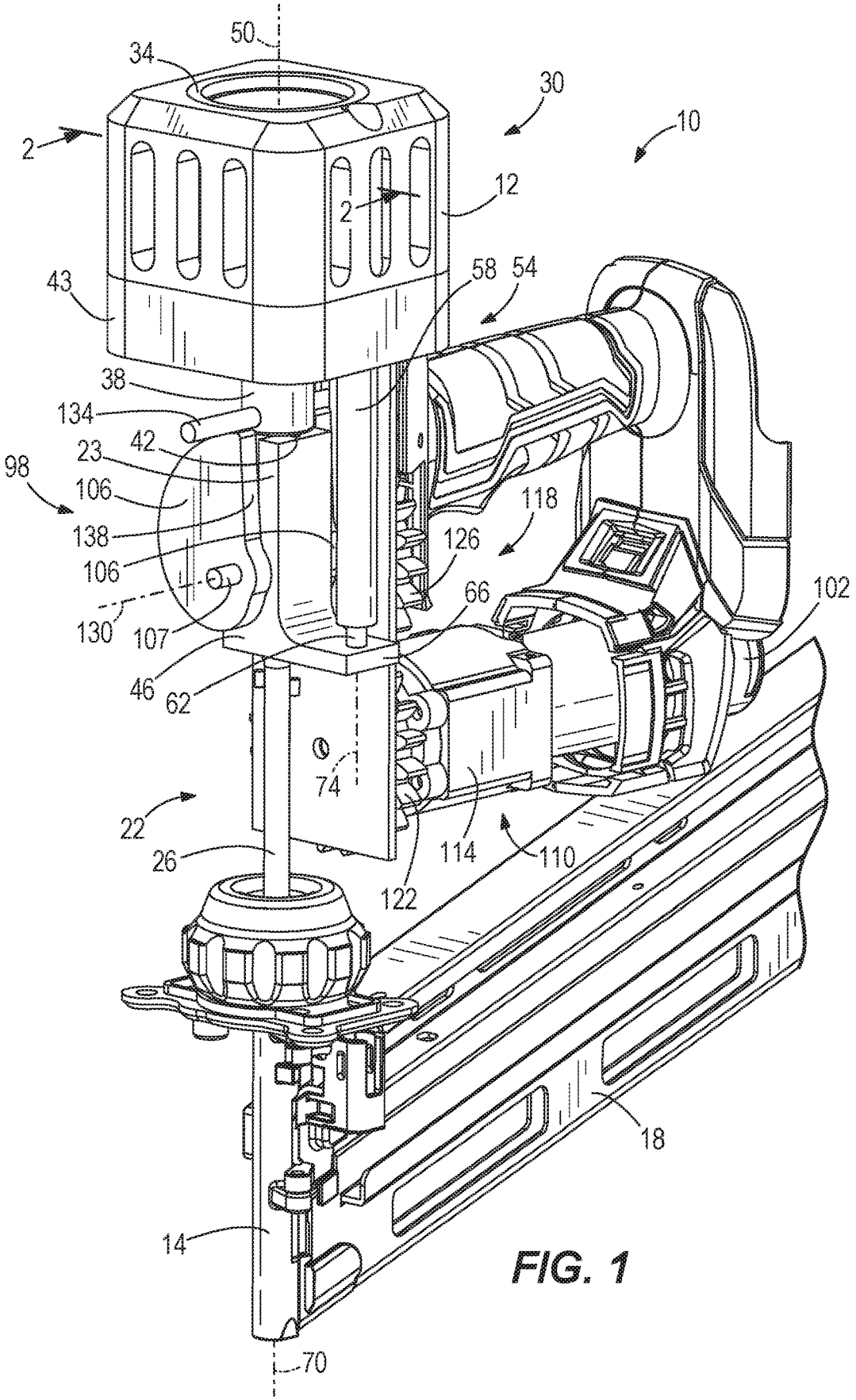
FIG. 1 is a front perspective view of a gas spring fastener driver in accordance with an embodiment of the invention, illustrating both a drive blade and a piston of a gas spring mechanism in a retracted position.

With reference to FIG. 1, a gas spring fastener driver 10 for driving fasteners (e.g., nails, tacks, staples, etc.) into a workpiece is shown. The fastener driver 10 includes a main housing 12, a nosepiece 14 extending from the main housing, and a magazine 18 for sequentially feeding collated fasteners into the nosepiece 14 prior to each fastener-driving operation. The fastener driver 10 also includes a drive blade 22, a tip 26 of which is received within the nosepiece 14, and an onboard gas spring mechanism 30 for driving the drive blade 22 from a retracted position (shown in FIG. 1) toward a driven position (not shown) coinciding with ejection of a fastener from the nosepiece 14. Accordingly, the fastener driver 10 does not require an external source of air pressure or other external power source for driving the drive blade 22.

Figure 2:
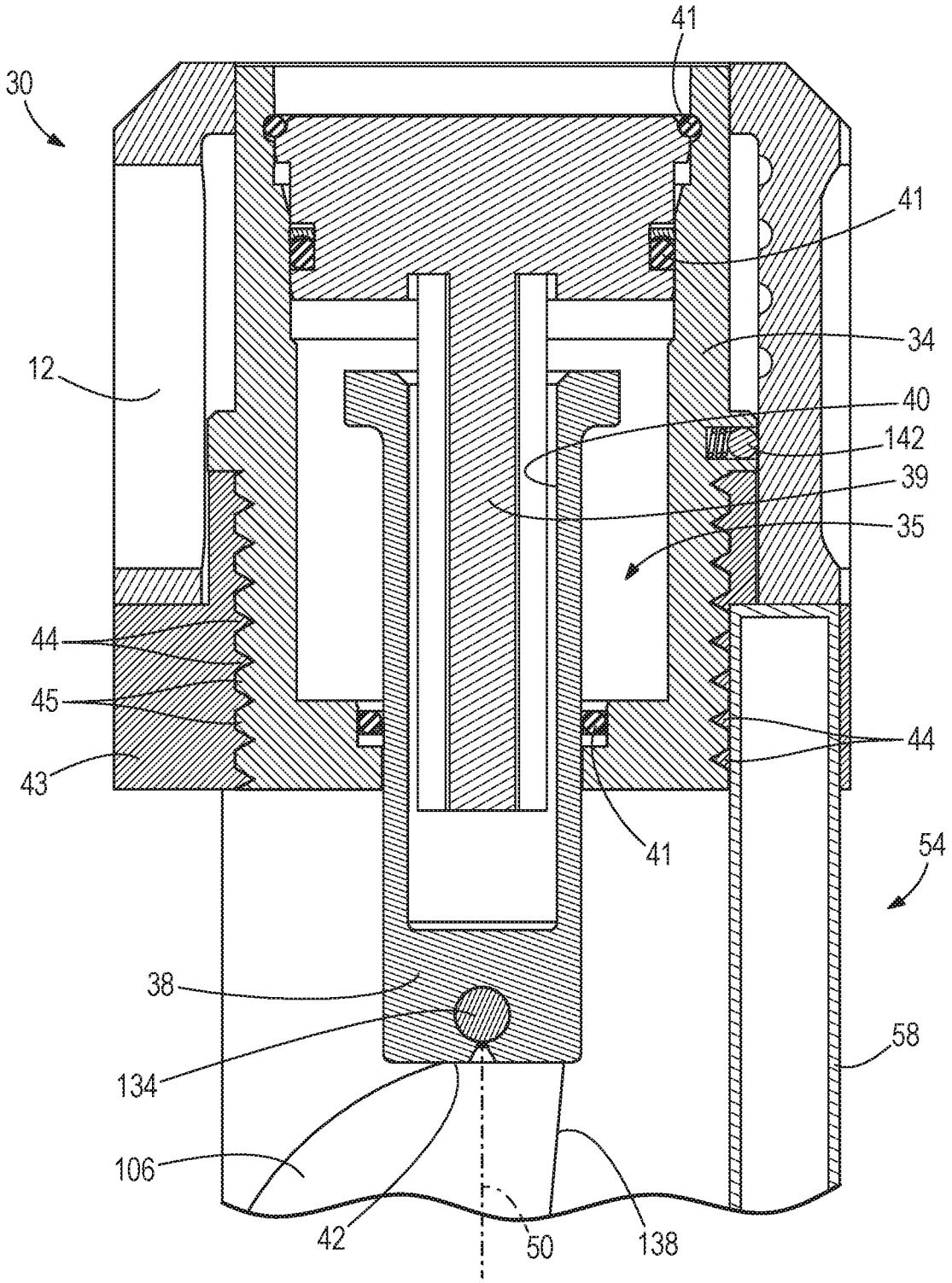
FIG. 2 is a partial cross-sectional view of the gas spring fastener driver of FIG. 1 taken along lines 2-2 shown in FIG. 1.
Figure 3:
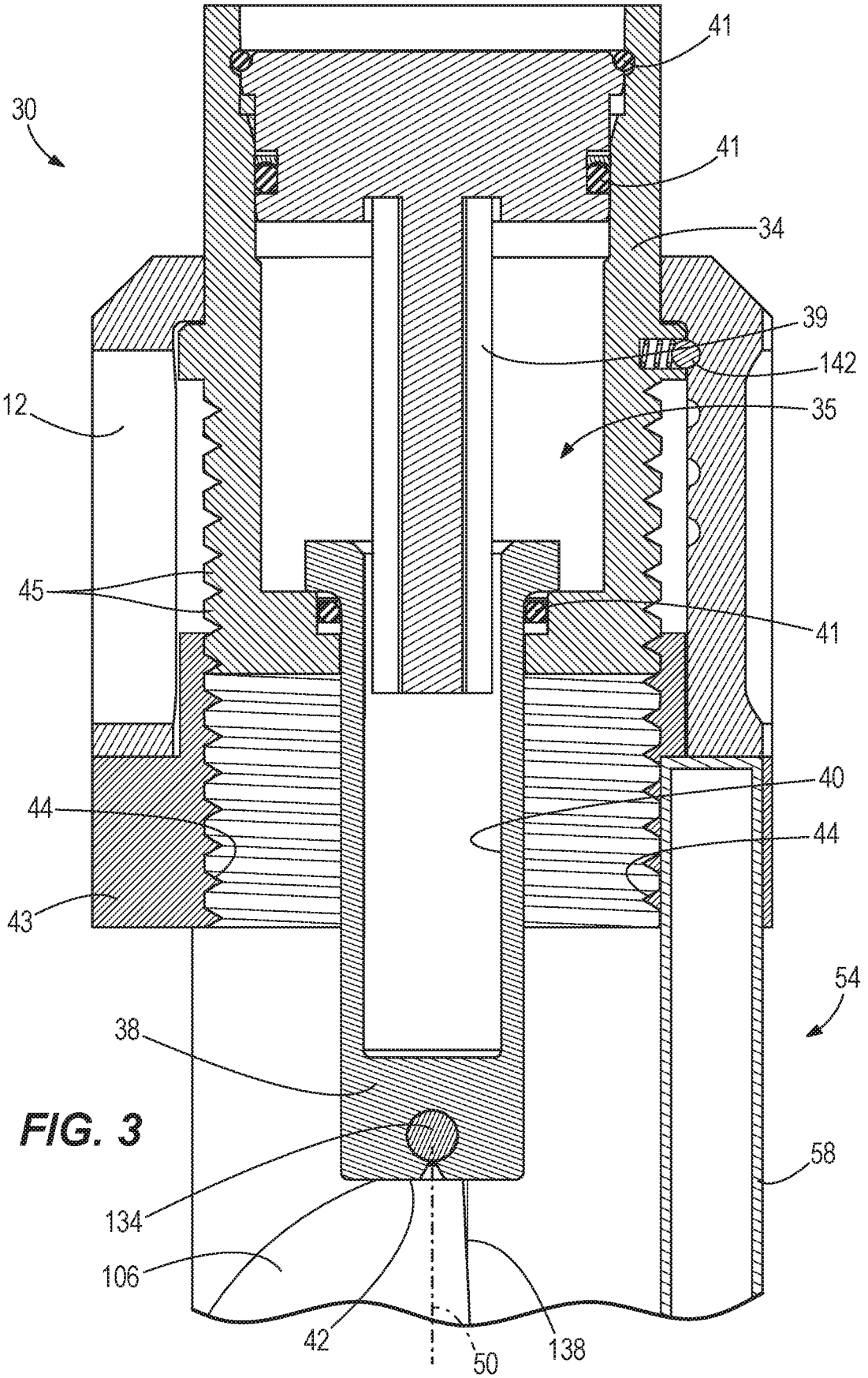
FIG. 3 is a partial cross-sectional view of the gas spring fastener driver of FIG. 1 taken along lines 2-2 shown in FIG. 1, illustrating a cylinder housing of the gas spring mechanism displaced away from the drive blade to reduce the pressure within the cylinder housing.

With reference to FIG. 1, the gas spring mechanism 30 includes a cylinder housing 34 in which a pressurized gas (e.g., air) is stored in an internal chamber 35 (FIGS. 2 and 3). A piston 38 protrudes from the cylinder housing 34. The pressurized gas in the chamber 35 biases the piston 38 toward a driven position (shown in FIG. 3) in which it is fully extended from the cylinder housing 34. In other words, the piston 38 is movable relative to the cylinder housing 34 and is biased by the pressurized gas from the retracted position (FIGS. 1 and 2) toward the driven position (FIG. 3). The gas spring mechanism 30 further includes a guide post 39 that is seated within an upper end of the cylinder housing 34. The guide post 39 is received within a corresponding bore 40 formed in the piston 38 to maintain alignment of the piston 38 as the piston 38 translates between the retracted and driven positions. O-rings 41 are provided for sealing the internal chamber 35 at the guide post 39 and the piston 38. The piston 38 includes a distal end 42 against which a head 46 of the drive blade 22 is abuttable when the drive blade 22 is in the retracted position (shown in FIG. 1). Movement of the drive blade 22 is limited to axial reciprocation, between the retracted position and the driven position. For example, movement of the drive blade 22 may be limited in this manner by one or more guide rails along which the head 46 of the drive blade 22 is slidable.

Figure 4:
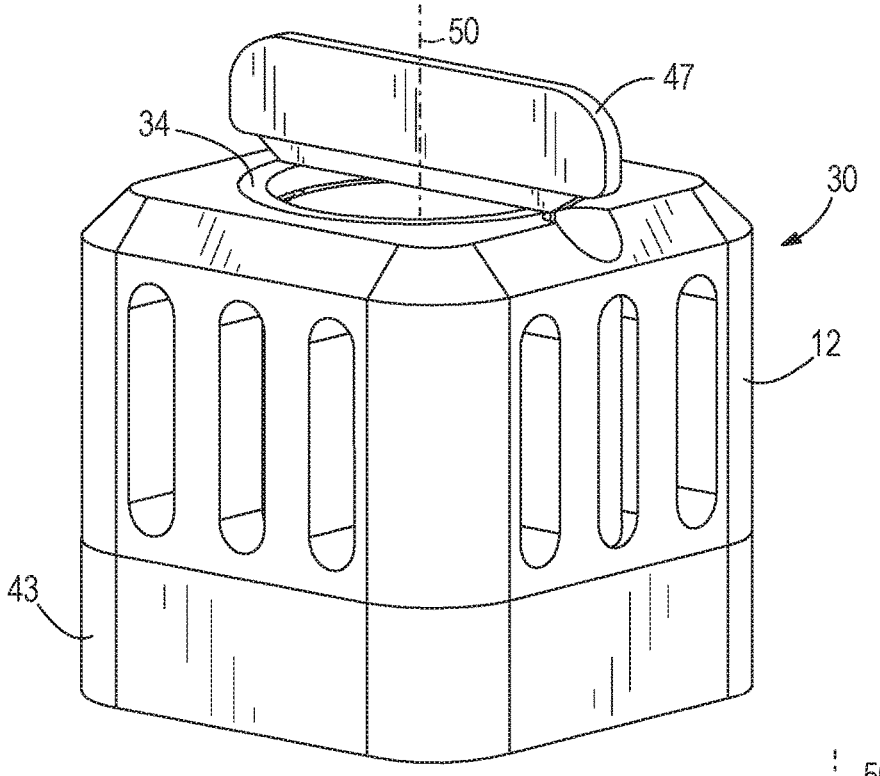
FIG. 4 is a perspective view of a gas spring mechanism embodiment including a lever.
Figure 5:
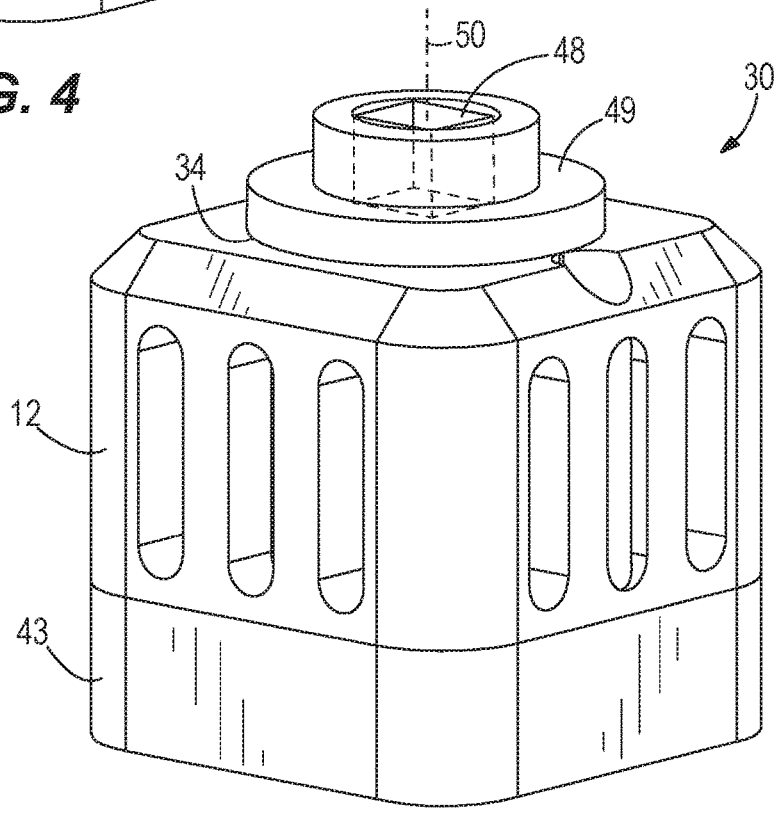
FIG. 5 is a perspective view of a gas spring mechanism embodiment including a socket.

As explained in greater detail below, the cylinder housing 34 is displaceable along a longitudinal axis 50 of the piston 38 relative to the main housing 12 and away from the drive blade 22. As the cylinder housing 34 is displaced, the piston 38 remains stationary relative to the main housing 12, thereby enlarging the effective volume of the chamber 35 and consequently reducing the pressure of the pressurized gas within the chamber 35 of the cylinder housing 34. In the illustrated embodiment, the cylinder housing 34 includes external threads 45 on an outer periphery thereof that are engageable with mating internal threads 44 of a mount 43 that is stationary relative to the main housing 12. In some embodiments, the threads 45 may extend along the entire length of the cylinder housing 34, and/or the main housing 12 and mount 43 may include mating threads along the entire lengths thereof to extend the range of adjustment of the cylinder housing 34. The cylinder housing 34 is displaceable along the longitudinal axis 50 in response to the rotation of the cylinder housing 34 relative to the mount 43 and main housing 12, for each complete revolution of the cylinder housing 34, by a distance dictated by the pitch of the mated threads 44, 45. In some embodiments, the cylinder housing 34 translates along the longitudinal axis 50 by a distance equal to the pitch of the treads 44, 45 in response to a complete rotation of the cylinder housing 34 relative to the main housing 12. In other words, a user rotates the cylinder housing 34 by manually gasping and rotating the cylinder housing 34. Additionally or alternatively, a lever 47 (FIG. 4) may be coupled to the cylinder housing 34 to increase the leverage that a user is able to apply to the cylinder housing 34, thereby increasing the amount of torque that can be applied to rotate the cylinder housing 34. Additionally, a socket 48 (FIG. 5) including a square, hex, or other cross-sectional shape may be formed on an axial end 49 of the cylinder housing 34 to allow a user to utilize a hand or power tool to rotate the cylinder housing 34. As explained in greater detail below, it is desirable to displace the cylinder housing 34 with respect to the main housing 12 when the fastener tool 10 becomes jammed, locking the piston 38 in place, to allow the user to de-energize the gas spring mechanism 30 before clearing the jam. Alternatively, the cylinder housing 34 may be displaceable along the longitudinal axis 50 in response to rotation of the mount 43 with respect to the main housing 12.

With reference to FIG. 1, the fastener driver 10 also includes a first return mechanism (i.e., an extensible cylinder 54) for raising the drive blade 22 from the driven position toward the retracted position. In the illustrated embodiment of the fastener driver 10, the extensible cylinder 54 includes a cylinder housing 58 affixed to the main housing 12 such that the cylinder housing 58 is stationary relative to the main housing 12 and the cylinder housing 34 of the gas spring mechanism 30. The cylinder housing 58 of the extensible cylinder 54 may be affixed directly to the main housing 12. Alternatively, the cylinder housing 58 of the extensible cylinder 54 may be affixed to an intermediate component of the fastener driver 10 which, either directly or indirectly, is affixed to the main housing 12.

The extensible cylinder 54 also includes a rod 62 coupled to the head 46 of the drive blade 22 for movement with the drive blade 22. In the illustrated embodiment of the fastener driver 10, the rod 62 is abutted against a flange 66 (FIG. 1) extending in a lateral direction from a longitudinal axis 70 of the drive blade 22, and secured to the flange 66 using a fastener (e.g., a screw). Alternatively, the rod 62 may be affixed to the head 46 of the drive blade 22 using a welding process, adhesives, an interference fit, or by integrally forming, for example. Accordingly, the rod 62 is axially movable between a retracted position coinciding with the retracted positions of the piston 38 and the drive blade 22 (shown in FIG. 1), and an extended position coinciding with the driven position of the drive blade 22 (not shown). A longitudinal axis 74 of the extensible cylinder 54, therefore, is oriented parallel with the longitudinal axis 70 of the drive blade 22. Alternatively, the rod 62 may be coupled directly to the main housing 12, and the cylinder housing 58 of the extensible cylinder 54 may be affixed to the drive blade 22. The cylinder housing 58 of the extensible cylinder 54 includes an interior chamber in which the rod 62 is slidable. A vacuum is created in the cylinder housing 58 for biasing the rod 62 toward a retracted position. Alternatively, the cylinder housing 58 includes a pressurized gas biasing the rod 62 toward the retracted position.

As is described in further detail below, between two consecutive firing operations of the fastener driver 10, the extensible cylinder 54 returns or raises the drive blade 22 from the driven position (coinciding with ejection of a fastener from the nosepiece 14) to a retracted position (shown in FIG. 1). The fastener driver 10 further includes a second return mechanism (i.e., a lifter mechanism 98), that raises the piston 38 from the driven position (FIG. 3) toward the retracted position (FIGS. 1 and 2). The first and second return mechanisms 54, 98 operate in parallel to return the drive blade 22 and the piston 38 to their respective retracted positions. Returning both the driver blade 22 and the piston 38 to the retracted positions in parallel increases the speed at which fasteners may be driven (i.e., the cycle time is reduced).

In the illustrated embodiment of the fastener driver 10 as shown in FIG. 1, the lifter mechanism 98 includes an electric motor 102 powered by an on-board power source (e.g., a battery), two rotatable cam lobes 106 mounted on a cam shaft 107, and a transmission 110 interconnecting the motor 102 and the cam lobes 106. The transmission 110 includes a planetary gear train 114 connected to an output shaft of the motor 102 and an offset gear train 118 connected to the output of the planetary gear train 114. Specifically, the offset gear train 118 includes a first gear 122 connected with the output of the planetary gear train 114, a second gear 126 enmeshed with the first gear 122 and connected with the cam shaft 107 and cam lobes 106. Accordingly, torque from the motor 102 is transferred through the planetary gear train 114 and the offset gear train 118, causing the cam lobes 106 to rotate about a rotational axis 130 of the second gear 126, which is coaxial with the cam shaft 107. The drive blade 22 includes a groove 23 that receives the cam shaft 107, so the drive blade 22 and the cam shaft 107 do not engage as the drive blade 22 is moved toward its raised position by the extensible cylinder 54. A spring-loaded pin (not shown) abuts the cam lobes 106 to prevent the piston 38 from back-driving the cam lobes 106 and motor 102.

With continued reference to FIG. 1, the piston 38 includes a follower 134 engaged with the cam lobes 106 while the piston 38 is raised from the driven position to the retracted position. In the illustrated embodiment of the fastener driver 10, the follower 134 is configured as a cylindrical pin that is slidable along the outer periphery of the cam lobes 106 in response to rotation of the cam lobes 106. In other words, the follower 134 is positioned between the cam lobes 106 and the piston 38. The follower 134 is coupled for movement with the piston 38 between the driven and retracted positions of the piston 38. Furthermore, the follower 134 protrudes from the piston 38 in a lateral (i.e., transverse) direction relative to the longitudinal axis of the piston 38 (which in the illustrated embodiment is coaxial with the longitudinal axis 70 of the driver blade 22), and the cam lobes 106 are positioned on either side of both the drive blade 22 and the piston 38.

In operation of the fastener driver 10, a first firing operation is commenced by the user depressing a trigger (not shown) of the fastener driver 10. Prior to pulling the trigger, the drive blade 22 and the piston 38 are held in their retracted positions, respectively, by the extensible cylinder 54 and the cam lobes 106 (shown in FIG. 1). Shortly after the trigger being depressed, the motor 102 is activated to rotate the cam lobes 106 in a counter-clockwise direction about the rotational axis 130 from the frame of reference of FIG. 1.

Upon the follower 134 sliding off the tip of the cam lobes 106, the pressurized gas within the cylinder housing 34 expands, pushing the piston 38 outward from the cylinder housing 34 and accelerating the drive blade 22 toward its driven position. The cam lobes 106 are accelerated to a sufficient rotational speed to prohibit subsequent contact with the follower 134 as the piston 38 is being driven from its retracted position to the driven position. In addition, the timing of the piston 38 reaching an intermediate position coincides with the follower 134 passing alongside a flat segment 138 of the cam lobes 106, thereby creating an unobstructed path for the follower 134 as the piston 38 is displaced from its retracted position toward its driven position.

After the piston 38 reaches its driven position, the head 46 of the drive blade 22 separates from the distal end 42 of the piston 38, ceasing further acceleration of the drive blade 22. Thereafter, the drive blade 22 continues moving toward its driven position at a relatively constant velocity. Upon impact with a fastener in the nosepiece 14, the drive blade 22 begins to decelerate, ultimately being stopped after the fastener is driven into a workpiece.

During the period of movement of the drive blade 22 from its retracted position to its driven position, because the rod 62 of the extensible cylinder 54 is affixed to the head 46 of the drive blade 22 for movement therewith, the rod 62 is also pulled from the cylinder housing 58. As the rod 62 is pulled from the cylinder housing 58, a vacuum is created within the cylinder housing 58. After movement of the drive blade 22 is stopped following the conclusion of the first firing operation, a pressure imbalance applies a force on the rod 62, causing it to retract into the cylinder housing 58. Because the rod 62 is affixed to the head 46 of the drive blade 22, the drive blade 22 is raised from its driven position toward the retracted position. As stated earlier, a pressurized gas within the extensible cylinder 54 may alternatively be utilized to raise the drive blade 22 from its driven position toward the retracted position.

Coinciding with the drive blade 22 rising toward the retracted position, rotation of the cam lobes 106 (in the same counter-clockwise direction) is resumed (or alternatively accelerated if previously slowed) to once again contact the follower 134. As the cam lobes 106 continue their rotation, the follower 134 and the piston 38 are displaced upward from the driven position toward the retracted position shown in FIG. 1. The cam lobes 106 continue to raise the piston 38 and the extensible cylinder 54 continues to raise the drive blade 22, in parallel, until both reach their retracted positions shown in FIG. 1, at which time the first firing operation is completed. Thereafter, additional firing operations may be initiated in a like manner.

In an alternative firing cycle, the lifter mechanism 98 may remain deactivated after the extensible cylinder 54 has returned the drive blade 22 to its rest or intermediate position, thereby maintaining the piston 38 in its driven position, until the user depresses the trigger to initiate a firing operation. This way, the gas spring mechanism 30 remains in a deactivated state (i.e., with the piston 38 in its biased, driven position) when the fastener driver 10 is not in use.

By providing the extensible cylinder 54 to return the drive blade 22 to its retracted position following each fastener firing operation (i.e., as opposed to using the lifter mechanism 98 to raise the drive blade 22 from its driven position to its retracted position), the cycle time between consecutive firing operations may be reduced, allowing for more rapid placement of fasteners into a workpiece.

With reference to FIG. 2, when a jam occurs in the fastener tool 10 the piston 38 may become stuck in the retracted position shown (i.e., an energized state). For example, rotation of the cam lobes 106 may be stopped before the follower 134 slides off the tip of the cam lobes 106. With the piston 38 stuck in the position shown in FIG. 2, the pressurized gas within the cylinder housing 34 continues to bias the piston 38 outward from the cylinder housing 34. Should the jam become clear, the energized state of the gas spring mechanism 30 may unintentionally urge the piston 38 to the driven position. As such, it is desirable to release the stored energy within the gas spring mechanism 30 when a jam occurs to de-energize the system before the jam is removed (i.e., cleared).

To release the stored energy within the gas spring mechanism 30 prior to clearing a jam, the user rotates the cylinder housing 34 relative to the main housing 12, causing the cylinder housing 34 to translate along the longitudinal axis 50 and away from the drive blade 22 (for each complete revolution of the cylinder housing 34) by a distance dictated by the pitch of the threads 44, 45. As the cylinder housing 34 is displaced, the piston 38 remains stationary relative to the main housing 12, enlarging the effective volume of the chamber 35 and consequently reducing the pressure of the pressurized gas within the cylinder housing 34. Said another way, rotation of the cylinder housing 34 by a user causes the cylinder housing 34 to move away from the piston 38 such that the volume within the cylinder housing 34 is increased and the pressure is reduced. With the gas spring mechanism 30 in the de-energized state of FIG. 3, there is no risk of the piston 38 inadvertently and unexpectedly moving to its driven position once the jam is cleared because the piston 38 is already in the driven position.

Upon the cylinder housing 34 reaching the position shown in FIG. 3 in which the gas spring mechanism 30 is de-energized, a position or proximity sensor (not shown) is triggered, thereby prompting a master control unit (also not shown) to activate the motor 102 to incrementally rotate the cam lobes 106 out of the way of the follower 134. With the cam lobes 106 disengaged from and misaligned with the follower 134, the cylinder housing 34 can be rotated by a user in an opposite direction to return the cylinder housing 34 to the position shown in FIG. 2, toward the drive blade 22 with the piston 38 in the driven position, without concern for the follower 134 contacting the cam lobes 106 and compressing the piston 38. In other words, the cylinder housing 34 and the piston 38 may be translated together toward the drive blade 22 without needing to displace the piston 38 with respect to the cylinder housing 34.

Alternatively, the user may simply reverse the rotation of the cylinder housing 34 by hand, without using tools, and without first moving the cam lobes 106 out of contact with the follower 134. The threads 44, 45 on the mount 43 and cylinder housing 34 provide the user enough leverage to translate the cylinder housing 34 while the piston 38 remains stationary to re-energize the gas spring mechanism 30. In other words, the threads 44, 45 enable the cylinder housing 34 to translate with respect to the piston 38 in order to increase the pressure within the gas spring mechanism 30. Specifically, the diameter of the screw and pitch of the threads 44, 45 are selected to provide enough mechanical advantage to allow a user to re-energize the gas spring mechanism 30.

Additionally or alternatively, adjusting the position of the cylinder housing 34 along the longitudinal axis 50 relative to the main housing 12 can adjust the depth to which a fastener is driven into a workpiece. Specifically, moving the cylinder housing 34 farther from the drive blade 22 (and allowing the piston 38 to partially extend from the cylinder housing 34 prior to initiating a fastener firing operation) reduces the amount of force that can be generated by the gas spring mechanism 30 and applied to the piston 38. Therefore, as the force applied to the piston 38 is reduced, the lower the depth to which a fastener may be driven into a workpiece during a fastener firing operation. The threads 44, 45 may be configured to be self-locking, such that a user can position the cylinder housing 34 at any location along the axis 50 where the threads 44, 45 remain engaged and the cylinder housing 34 would remain in position while operating the fastener driver 10. Essentially, the threads 44, 45 are designed so they cannot be back driven by the reaction force exerted on the cylinder housing 34 by the piston 38. Alternatively, a detent system 142 (FIGS. 2 and 3) may be used instead of relying upon the threads to self-lock. Such a detent system 142 may include a spring-biased detent carried by the cylinder housing 34 or the main housing 12/mount 43 and a series of recesses in the other of the cylinder housing 34 or the main housing 12/mount 43 in which the detent is receivable to positively secure the cylinder housing 34 in a particular axial position along the axis 50 relative to the main housing 12/mount 43.

Various features of the invention are set forth in the following claims.

What is claimed is:

1. A fastener driver comprising:

a main housing;

a drive blade movable from a retracted position to a driven position for driving a fastener into a workpiece;

a gas spring mechanism for driving the drive blade from the retracted position to the driven position, the gas spring mechanism including a cylinder housing containing a pressurized gas, and a piston separable from the drive blade and movable relative to the cylinder housing and biased by the pressurized gas from a retracted position toward a driven position; and a detent system including a detent positioned on one of the main housing and the cylinder housing, and a plurality of recesses positioned on the other of the main housing and the cylinder housing;

wherein the cylinder housing is displaceable along a longitudinal axis of the piston relative to the main housing and away from the drive blade, while the piston remains stationary relative to the main housing, to reduce the pressure of the pressurized gas within the cylinder housing, and wherein the detent system selectively secures the cylinder housing in a particular position relative to the main housing.

2. The fastener driver of claim 1, wherein the cylinder housing includes external threads on an outer periphery thereof engageable with mating internal threads that are stationary relative to the main housing.

3. The fastener driver of claim 2, wherein the cylinder housing is displaceable along the longitudinal axis in response to rotation of the cylinder housing relative to the main housing.

4. The fastener driver of claim 3, wherein the cylinder housing translates along the longitudinal axis by a distance equal to a pitch of the external threads in response to a complete rotation of the cylinder housing relative to the main housing.

5. The fastener driver of claim 2, wherein the external threads are self-locking with the internal threads.

6. The fastener driver of claim 1, further comprising a lever coupled to the cylinder housing, wherein the lever is graspable by a user to rotate the cylinder housing.

7. The fastener driver of claim 1, wherein the cylinder housing includes an axial end formed with a socket.

8. The fastener driver of claim 1, further comprising a first return mechanism for raising the drive blade from the driven position toward the retracted position.

9. The fastener driver of claim 8, further comprising a second return mechanism for raising the piston from the driven position toward the retracted position.

10. The fastener driver of claim 9, wherein the first return mechanism includes an extensible cylinder.

11. The fastener driver of claim 9, wherein the first return mechanism and the second return mechanism operate in parallel to return the drive blade and the piston to the respective retracted positions.

12. The fastener driver of claim 9, further comprising a sensor configured to detect the position of the cylinder housing with respect to the main housing.

13. The fastener driver of claim 12, wherein in response to the sensor detecting the cylinder housing is a pre-determined distance away from the main housing, the second return mechanism is energized.

14. The fastener driver of claim 1, wherein the depth to which the fastener is driven by the drive blade is adjusted by displacing the cylinder housing along the longitudinal axis of the piston relative to the main housing.

15. The fastener driver of claim 1, wherein the gas spring mechanism further comprises a guide post positioned within the cylinder housing, and wherein the guide post is received within a corresponding bore formed in the piston.

16. A fastener driver comprising:

a main housing;

a drive blade movable from a retracted position to a driven position for driving a fastener into a workpiece; and a gas spring mechanism for driving the drive blade from the retracted position to the driven position, the gas spring mechanism including a cylinder housing containing a pressurized gas, a piston separable from the drive blade and movable relative to the cylinder housing and biased by the pressurized gas from a retracted position toward a driven position, and a guide post positioned within the cylinder housing, wherein the guide post is received within a corresponding bore formed in the piston;

wherein the cylinder housing is displaceable along a longitudinal axis of the piston relative to the main housing and away from the drive blade, while the piston remains stationary relative to the main housing, to reduce the pressure of the pressurized gas within the cylinder housing, and wherein the piston is movable relative to the guide post.

* * * * *